US005382805A

United States Patent [19]

Fannon et al.

[11] Patent Number: 5,382,805

[45] Date of Patent: Jan. 17, 1995

[54] DOUBLE WALL INFRARED EMITTER

[76] Inventors: Mark G. Fannon, 14462 Grenwich, 213-B, Shelby Township, Macomb County, Mich. 48315; John J. Fannon, III, 725 Westchester, Grosse Pointe Park, Mich. 48230

[21] Appl. No.: 146,480

[22] Filed: Nov. 1, 1993

[51] Int. Cl.[6] ..... H01K 1/28

[52] U.S. Cl. ..... 250/504 R; 250/493.1; 250/424

[58] Field of Search ..... 250/504 R, 509 H, 503.1, 250/493.1; 313/113; 392/422–424

[56] References Cited

U.S. PATENT DOCUMENTS

| | | | |
|---|---|---|---|
| 2,864,025 | 12/1958 | Foote et al. | 313/279 |
| 2,910,605 | 10/1959 | Hodge | 313/113 |
| 3,157,775 | 11/1964 | Harmon | 219/347 |
| 3,160,777 | 12/1964 | Holcomb | 313/113 |
| 3,211,938 | 10/1965 | Holcomb | 313/113 |
| 3,316,405 | 4/1967 | Astheimer . | |
| 3,449,546 | 6/1969 | Dhoble | 219/216 |
| 3,622,832 | 11/1971 | Schlessel | 313/318 |
| 3,804,691 | 4/1974 | Trivedi | 156/272 |
| 4,101,424 | 7/1978 | Schooley et al. | 250/504 R |
| 4,159,411 | 6/1979 | Ellersick | 219/346 |
| 4,227,113 | 10/1980 | Walsh | 313/112 |
| 4,346,323 | 8/1982 | Hirschfeld | 313/111 |
| 4,552,789 | 3/1987 | Kawakatsu et al. | 313/112 |
| 4,588,923 | 5/1986 | Hoegler et al. | 313/579 |
| 4,598,194 | 7/1986 | Halberstadt et al. | 219/264 |
| 4,604,680 | 8/1986 | Levin et al. | 362/293 |
| 4,716,658 | 1/1988 | Jacobi, Jr. | 250/495.1 |
| 4,791,333 | 12/1988 | Morris et al. | 313/25 |
| 4,792,716 | 12/1988 | Walsh | 313/113 |
| 4,797,535 | 1/1989 | Martin | 219/338 |
| 4,839,559 | 6/1989 | Ahlgren et al. | 313/579 |
| 5,003,284 | 3/1991 | Dieudonné | 338/237 |
| 5,157,758 | 10/1992 | Halberstadt et al. | 392/408 |
| 5,276,763 | 1/1994 | Göbel et al. | 392/422 |

FOREIGN PATENT DOCUMENTS

| | | |
|---|---|---|
| 2637338 | 2/1978 | Germany . |
| 1544551 | 4/1979 | United Kingdom . |
| 2176587A | 12/1986 | United Kingdom . |

OTHER PUBLICATIONS

Brochure entitled *Goldenrod TM 24k Pure Gold on Quartz!*, Thermal Devices Division, John J. Fannon Company, Inc., 1983.

Brochure entitled *Heraeus Infrared Systems for the Automotive Industry, Fast Routes to Improved Quality*, Heraus Amersil, Inc., undated.

*Primary Examiner*—Jack I. Berman
*Assistant Examiner*—James E. Beyer
*Attorney, Agent, or Firm*—Varnum, Riddering, Schmidt & Howlett

[57] ABSTRACT

An infrared energy emitter is disclosed which comprises a longitudinally extending tubular enclosure of infrared energy transmitting material enclosing a longitudinally extending filament. A longitudinally extending outer tubular sheath of infrared energy transmitting material coaxially receives the tubular enclosure. The outer sheath has a reflector which extends longitudinally substantially coextensive with the filament, and circumferentially with the sheath through at least 180 degrees to create a window through which the infrared energy is emitted. A cooling fluid may be passed through a space created between the inner envelope and outer sheath to allow higher power densities or to cool the outer sheath for use in explosive environments.

18 Claims, 4 Drawing Sheets

DOUBLE WALL INFRARED EMITTER

BACKGROUND OF THE INVENTION

1. Field of the Invention

The invention relates to infrared energy emitters having a filament within a tubular envelope, and more specifically to infrared emitters further having an external sheath surrounding the envelope.

2. State of the Prior Art

Infrared emitters provide radiant heat in numerous applications. For instance, they are the preferred heat source for drying paints applied to metal surfaces, including solvent based paints, water based paints, and powder paints. They also provide heat for environmental test chambers and many industrial processes.

Typically, an infrared emitter comprises a slender tubular quartz envelope containing an elongated coiled filament that extends through the envelope and connects to lead-in conductors at opposite ends of the envelope. Infrared emitters may be provided in a variety of designs depending upon the desired wavelength and power density of emitted energy.

Infrared radiation emanates from the filament in all directions in a spherical pattern, and thus the power of the radiant energy decreases in proportion to the square cube of the distance from the emitter. In general, infrared emitters are employed to heat a particular object, such as a car body in a paint curing process. Only the energy which actually strikes the object is transferred to the object as heat energy, and of the energy which strikes the object, a portion will be reflected, a portion will be absorbed, and depending upon the object, a portion may be transmitted through the object. Only the radiant energy which actually strikes the object and is absorbed provides heat to the object. The remaining radiant energy is simply lost to the environment, thereby reducing the overall energy transfer efficiency from the infrared emitter to the object to be heated. Of course, some of the nonabsorbed radiant energy may heat the atmosphere in which the object to be heated resides, and thus be transferred to the object by convection and conduction. However, this effect is typically, either undesired or negligible.

To improve the radiant energy transfer efficiency, the radiant energy leaving the emitter is generally focused in some manner toward the object to be heated. For instance, the infrared emitters are often employed within an enclosed chamber having reflective walls. Thus, energy not directly passing from the infrared emitter to the object and absorbed by the object, continues to be reflected off of the surfaces of the chamber until it strikes the object, escapes from an opening in the chamber or dissipates through inefficiencies in the reflectors. In most applications, more direct focusing of the radiant energy greatly improves the overall transfer efficiency. For instance, in some applications, external elongated reflectors adjacent the infrared emitters focus the emitted radiant energy in the direction of the object to be heated.

In many applications, infrared emitters are used in environments where cleanliness is essential and the heating chamber must be kept free of particulate matter. Flat walls in a heating chamber are much easier to clean and accumulate less dust than walls forming external reflectors for the infrared emitters. External reflectors that are not incorporated into the chamber walls also tend to accumulate dust and are difficult to clean.

A gold reflective coating on the outer surface of the infrared emitter can form an integral reflector. Infrared emitters with reflective gold coatings, used in a chamber with flat reflective walls, improve cleanliness in the heating chamber environment. The flat chamber walls do not tend to accumulate dust and clean easily. Additionally, there are no external reflectors to accumulate dust and be cleaned. An additional advantage of reflective coatings is reduced expense versus external reflectors. Thus, it can be appreciated that the gold reflective coating provides energy efficiency and cleanliness at a reasonable cost, making the gold reflective coating a highly desirable feature. However, the gold reflective coating places certain restrictions upon the infrared emitter design.

The emitter envelope absorbs a small portion of the infrared energy. If present, reflective metal coatings, while highly reflective, absorb a portion of the infrared radiation and become heated. Also, some of the filament's heat transfers to the emitter envelope through conduction and convection to heat the emitter envelope to high temperatures. Air tight end seals at the ends of the filament seal the envelope around the filament. Typically, temperatures above 650° F. damage or destroy the seals, placing a practical upper limit upon the temperature of the envelope. Further, a gold metal reflective coatings may simply vaporize off of the surface of the envelope if heated to too high of a temperature.

External requirements may also affect the temperature requirements of the envelope. For instance, when the emitters are operating in a combustible atmosphere, it is extremely important to keep the envelope operating temperature to a minimum. For instance, the National Fire Protection Association's National Electric Code, which has been adopted by many communities as the local electric code, requires a maximum surface temperature of no more than 329° F. in certain organic dust filled atmospheres. Standard T3 tungsten filament infrared emitters are rated for a 392° F. minimum surface temperature.

Both the wavelength and the power density of the emitted infrared energy affect the envelope temperature, with the power density the most influential factor. Thus, the power density of the emitter is limited by the design of the infrared emitter and by the operating environment. The power density, of tungsten filament infrared emitters is typically 100 watts/lineal inch of filament length. Higher power densities adversely affect the end seals and reflective coatings. Power densities are further limited in many explosive atmospheres.

SUMMARY OF THE INVENTION

The present invention overcomes these and other limitations by providing an external sheath of quartz or other highly transmissive material about the infrared emitter envelope, with a reflective metal coating applied to the outer sheath.

An infrared energy emitter according to the invention comprises a longitudinally extending filament and a tubular enclosure of infrared energy transmitting material enclosing the filament. A longitudinally extending outer tubular sheath of infrared energy transmitting material ensheathes the tubular enclosure and is provided with a reflector. The outer sheath is spaced apart from the inner tubular enclosure thereby allowing the infrared emitter to run at high power densities while maintaining a relatively cool outer surface temperature.

In one embodiment of the invention, the reflector has a semicircular cross-sectional shape. Advantageously in accordance with this invention, energy is reflected back onto the filament thereby reducing emitter power requirements.

In accordance with one particular aspect of the invention, the space formed between the outer sheath and inner enclosure is provided with openings and may be ventilated to further reduce the outer surface temperature of the infrared emitter and enhance its ability to operate at high power densities. In one particular embodiment, fluid conductive filters are provided at each end of the sheath to filter cooling fluid passed through the space.

BRIEF DESCRIPTION OF THE DRAWINGS

The invention will now be described with reference to the accompanying drawings in which.

DETAILED DESCRIPTION OF THE DRAWINGS

Figure 1:
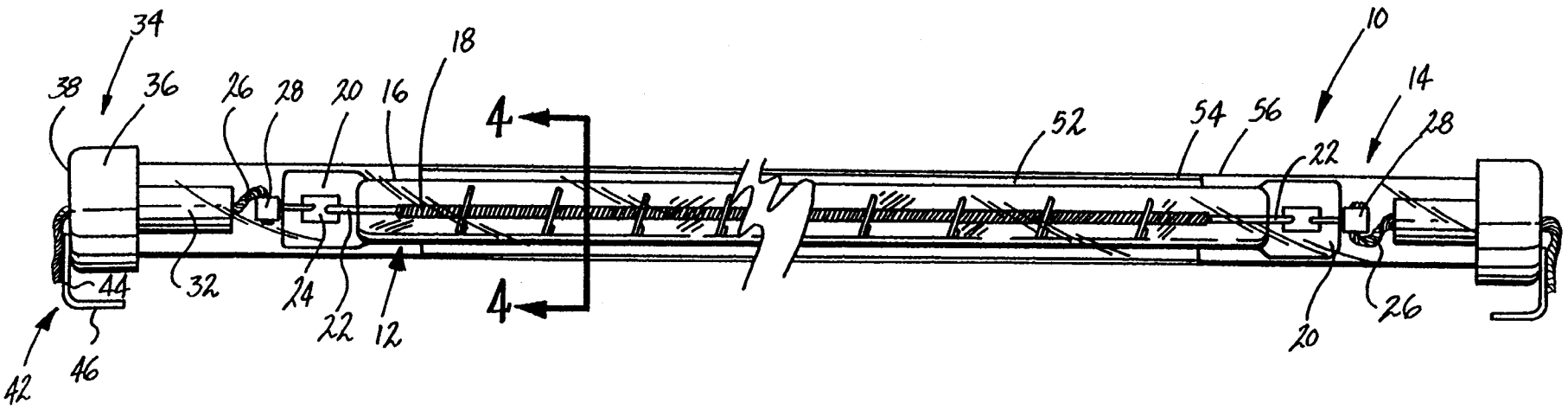
FIG. 1 is a front elevational view of an infrared emitter according to the invention.

FIG. 1 illustrates an infrared emitter 10 according to the invention which emits electromagnetic radiation in the infrared (IR) portion of the spectrum. The infrared emitter 10 generally comprises an elongated inner element 12 received within a tubular outer sheath 14. The inner element 12 comprises an elongated tubular envelope 16 of quartz or silica, preferably quartz, and an incandescent helically coiled tungsten wire filament 18 extends coaxially within the envelope. A pinch seal 20 closes each end of the envelope 16, and lead-in conductors 22, each having a thin foliated intermediate portion 24, extend longitudinally into the envelope 16 through the pinch seal 20 and connect to the filament 18.

Infrared emitters, such as represented by inner elements 12 are commercially available. A more detailed description of the inner element 12 can be found in U.S. Pat. No. 2,864,025 to Foote et al., incorporated herein by reference.

Commonly, infrared emitters are divided in two broad categories: short wave emitters having a wavelength of 0.9 to 2.3 microns and employing a tungsten filament, and medium wavelength emitters having a wavelength of 2.3 to 4.5 microns and employing a nichrome filament. The wavelength of the energy emitted by an infrared emitter depends upon the temperature of the filament. For instance, a tungsten filament heated to 4,000° F. will emit radiant energy with 75% of the energy emitted in a band width ranging from 0.9 microns to 1.5 microns, with a 1 micron peak wavelength. In contrast, a nichrome filament heated to 1600° F. will emit radiant energy in a band width having its peak at 3 microns. Although the inner element 12 is described with respect to a tungsten filament 18 operating in the short infrared range, it will be appreciated that the principles of the invention may be applied to nichrome and other filaments operating in any portion of the infrared spectrum.

Figure 2:
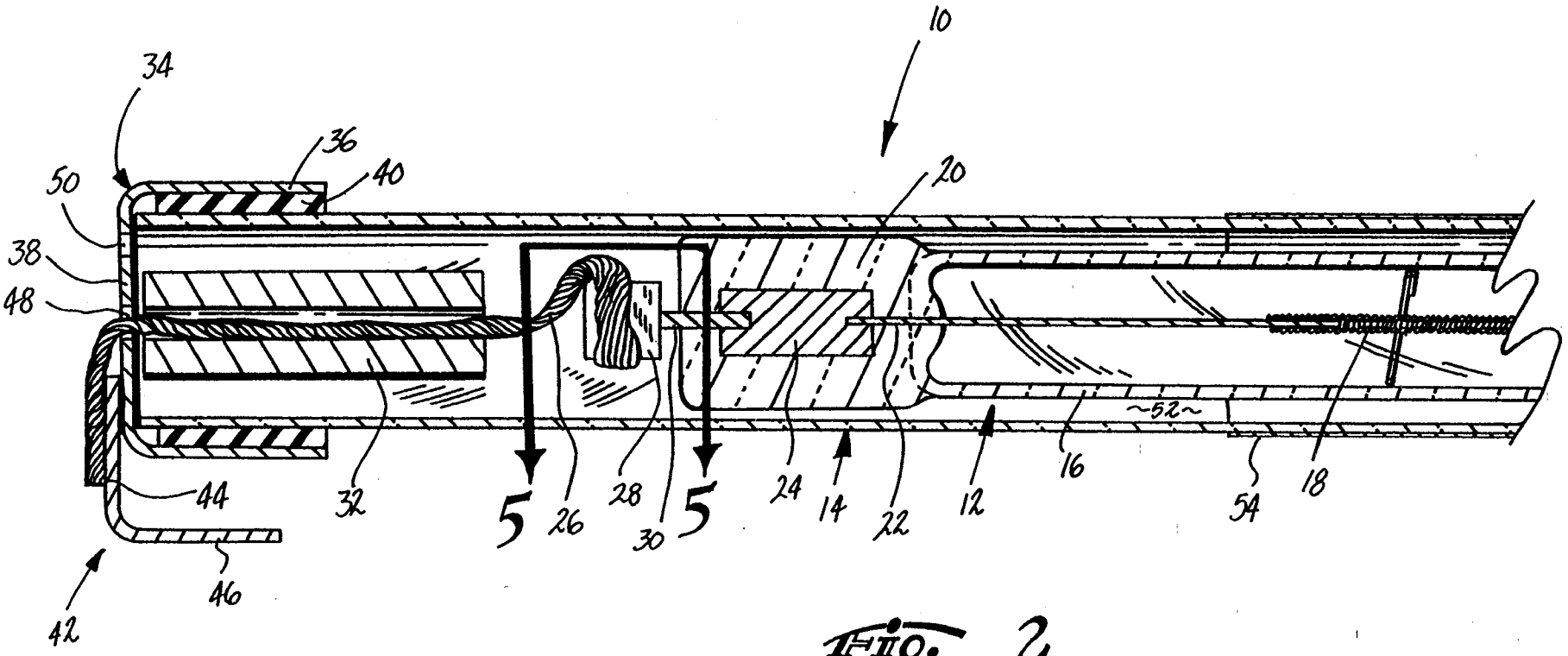
FIG. 2 is a detailed sectional view of an end portion of the infrared emitter of FIG. 1.
Figure 5:
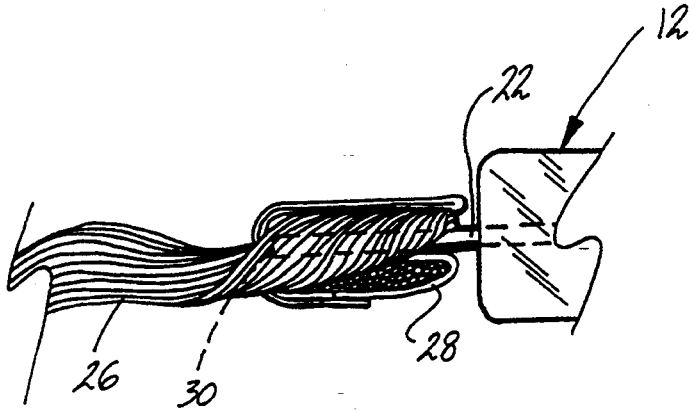
FIG. 5 is a sectional view taken along line 5—5 of FIG. 2.

Turning to FIGS. 2 and 5, stranded lead wires 26 crimp onto the lead-in conductors 22 with the aid of crimping strips 28. The crimping strip 28 comprises a short strip of crimpable metal formed into a loop. The lead wire 26 is received within the loop, and the loop is flattened so that the crimp strip extends radially away from one side of the lead wire 26. The portion of the crimp strip 28 receiving the lead wire 26 is placed adjacent to the lead-in conductor 22. The lead wire 26 is wrapped over the lead-in conductor 22 and held thereto by a portion of the crimp strip 28 wrapped about a terminal end 30 of the lead-in conductor 22.

The lead-in wires 26 extend from the lead-in conductor 22 coaxially through a tubular steatite ceramic spacer 32 and out of the open ends of the outer sheath 14. Cup-shaped stainless steel retainer caps 34, having a cylindrical wall 36 extending from a circular end wall 38, fit over the ends of the outer sheath 14. The inner diameter of the retainer cap cylindrical wall 36 slightly exceeds the outer diameter of the outer sheath 14, and a high temperature gasket material 40 fits therebetween and attaches the retainer cap 34 to the outer sheath 14. An L-shaped retainer clip 42 attaches to the retainer cap 34 and comprises a radial leg 44 parallel with and affixed to the retainer cap end wall 38, and also a return leg 46 spaced apart from, yet axially aligned with, the retainer cap cylindrical wall 36. The retainer clip 42 fits within a standard connector (now shown) and aids in providing the proper rotational orientation of the infrared emitter 10 within the connector.

Figure 3:
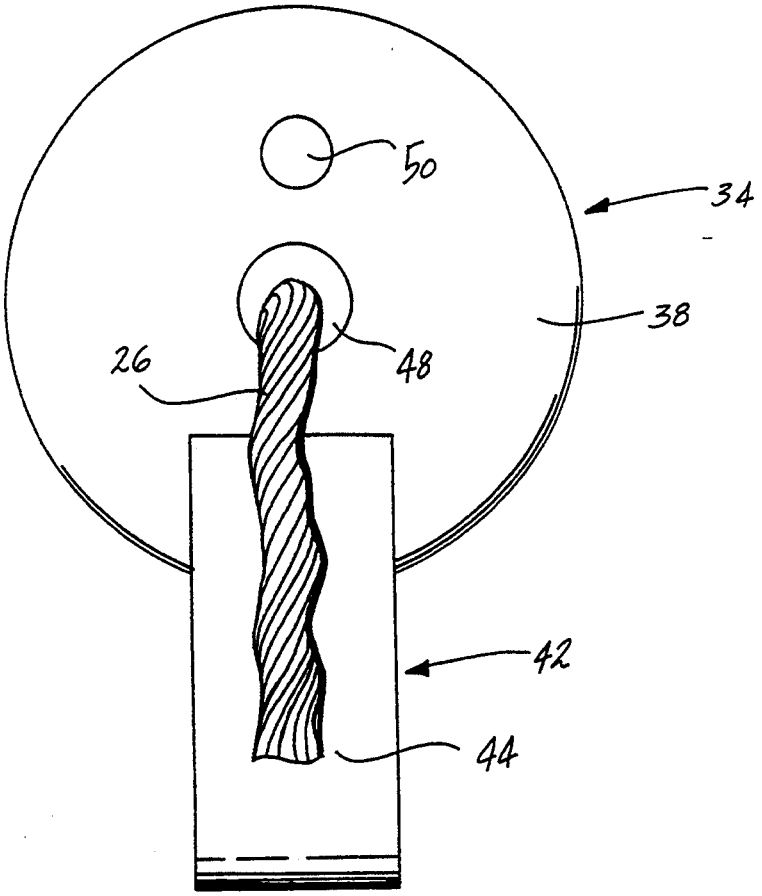
FIG. 3 is an end view of the infrared emitter of FIG. 1.

Turning to FIG. 3, the lead wire 26 extends through an aperture 48 in the center of the retainer cap end wall 38, and attaches to the retainer clip 42 or retainer cap 34 in a conventional fashion, as by spot welding. The retainer cap end wall 38 also has a breather hole 50 for ventilating an interior space 52 between the inner element 12 and outer sheath 14 (see FIG. 2). Alternatively, the retainer cap 34 may be formed of a conductive porous stainless steel or other metal, such as employed in fuel filters in some carburetors for internal combustion engines. Preferably, such a porous metal filters particles above 10 microns.

Ventilation of the inner space 52 may be allowed to occur naturally as through the normal circulation of air in the operating environment of the infrared emitter 10. Alternatively, a cooling fluid such as air or other nonconductive fluids, may be forced through the inner space 52 for an enhanced cooling effect upon the inner element 12 and outer sheath 14. The forced cooling fluid may comprise a nonconductive liquid.

Figure 4:
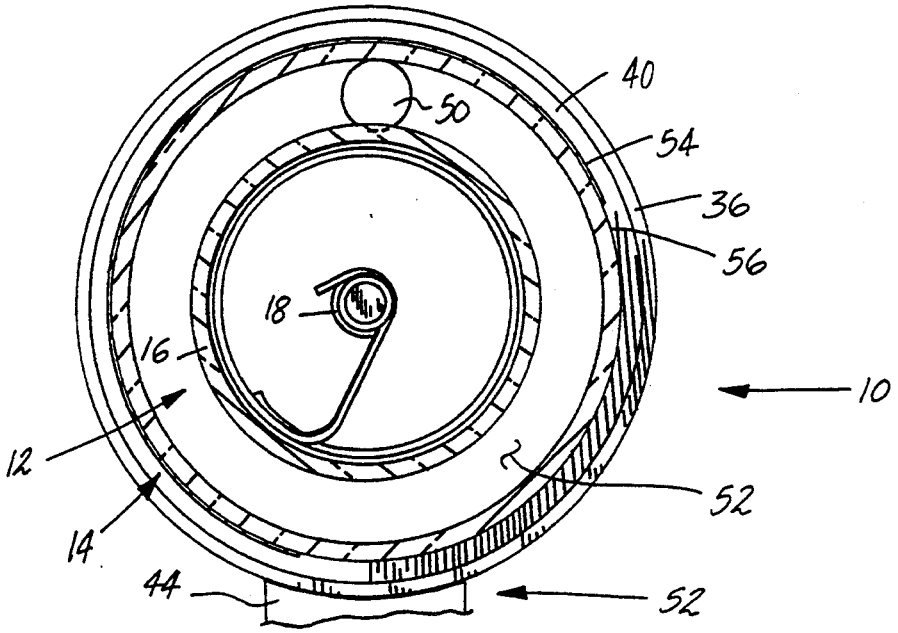
FIG. 4 is a sectional view taken along line 4—4 of FIG. 1.
Figure 6:
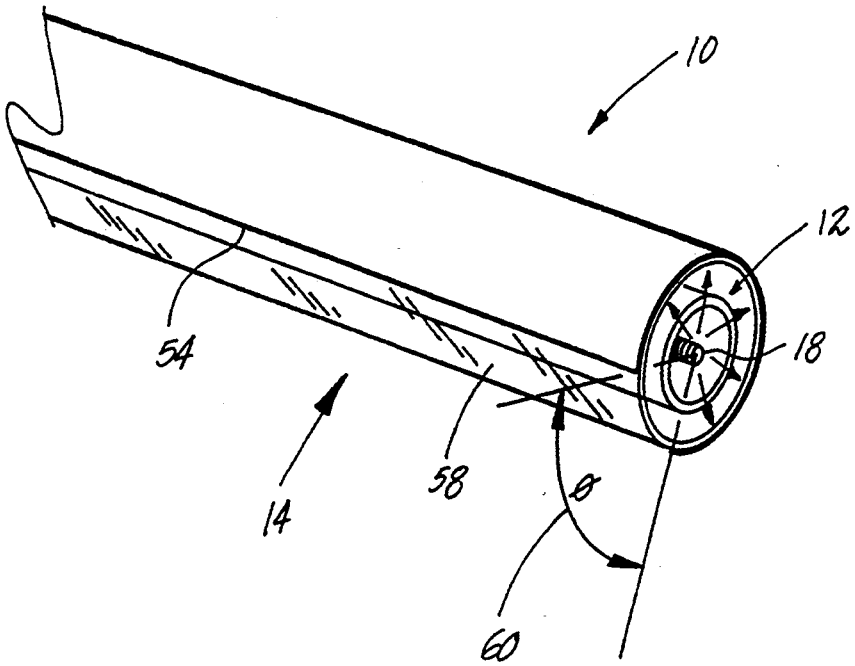
FIG. 6 is a perspective sectional view taken along line 6—6 of FIG. 1.

Turning to FIGS. 4 and 6, a reflective coating 54 is applied to an outer surface 56 of the outer sheath 14. A reflective coating applied to an infrared emitter, such as coating 54, typically is less than a thousandth of an inch thick, as described in U.S. Pat. No. 3,804,691 issued Apr. 16, 1974 to Trivedi. The reflective coating 54 extends longitudinally substantially in register with the filament 18, and circumferentially about the outer sheath 14 and thus creates a longitudinal window 58 along one side of the outer sheath 14 not covered by the reflective coating 54. Radiant energy from the filament 18 reflects off of the reflective coating 54 back into the infrared emitter 10, and the window 58 disperses infrared radiation through a focused solid angle 60. The magnitude of the angle 60 depends upon the predetermined radial width of the window 58, which is established according to the requirements of a particular application for the infrared emitter 10 and may vary from less than 1° to nearly 360°. Typically, an angle 60 of 90° provides good dispersion for heating large objects. The reflective coating 54, thus, directs the radiation from the infrared emitter 10 in a desired direction to improve the efficiency of the infrared emitter 10.

Infrared radiation radiates in all directions from the filament 18 which lies along the central axis of the outer sheath 14. Thus, radiation emanating out to the reflective coating 54 tends to be reflected directly back onto the filament 18, thereby raising its operating temperature and decreasing the infrared emitter 10 power requirements.

By placing the reflective coating 54 on the outer sheath 14, higher maximum power densities may be achieved. Typical prior single tube tungsten filament infrared emitters, having a gold reflective coating, have maximum power densities of 40 to 50 watts/lineal inch. The infrared emitter 10 may be designed with a maximum power density of approximately 600 watts/lineal inch. The increased distance of the reflective coating 54 from the filament 18 achieved by placing a coating on the outer sheath contributes greatly to the higher maximum power density of the infrared emitter 10. The insulating effect of the inner space 52 reduces the temperature of the reflective coating 54 and thus also increases the allowable maximum power density of the infrared emitter 10 without damaging the reflective coating 54.

Even higher power densities may be achieved by ventilating the inner space 52 with a cooling fluid as previously described. Forced cooling in this manner also cools the inner element envelope 16 so that the temperature of the pinch seal 20 will not exceed 650° F. In an explosive atmosphere, forced cooling with a cooling fluid in the space 52 maintains the outer temperature of the sheath 14 within acceptable limits, even at high power densities. The double walled infrared emitter 10, thus provides a significant advantage over prior single walled emitters.

When a mercury vapor is placed within the inner element envelope 16, the infrared emitter 10 will also emit ultraviolet (UV) radiation. The filament 18 will heat and excite the mercury vapor atoms, causing them to release UV radiation. In some paint curing processes a photo-initiator in the paint aids in curing the paint in the presence of UV radiation. The infrared emitter 10 with mercury vapor would obviate the requirement for additional UV emitters in such a process.

In most instances, however, UV radiation from the infrared emitter 10 is undesirable as it can be harmful to personnel. The filament 18, although emitting primarily in the infrared spectrum, emits a small amount of UV radiation in all types of infrared emitters. Since quartz absorbs radiation in the UV spectrum, the quartz outer sheath 14 acts as a UV filter and aids in reducing trace UV radiation.

While particular embodiments of the invention have been shown, it will be understood, of course, that the invention is not limited thereto since modification may be made by those skilled in the art, particularly in light of the foregoing teachings. Reasonable variation and modification are possible within the foregoing disclosure of the invention without departing from the scope of the invention.

The embodiments of the invention in which an exclusive property right or privilege is claimed are defined as follows:

1. An infrared energy emitter comprising:

a longitudinally extending energy emitting filament;

a longitudinally extending tubular enclosure of infrared energy transmitting material enclosing the filament;

a longitudinally extending outer tubular sheath of infrared energy transmitting material having two ends and a central longitudinal section therebetween;

a reflector comprising a reflective coating on a surface of the sheath extending partially circumferentially with the sheath; and the central longitudinal section of the sheath being spaced apart from the enclosure about the entire circumference of the enclosure sufficiently to protect the reflective coating from the infrared energy being emitted by the filament.

2. An infrared energy emitter according to claim 1 wherein the enclosure is hermetically sealed, the filament comprises tungsten and a gas filling the enclosure comprises a halogen.

3. An infrared energy emitter according to claim 1 wherein the reflective coating comprises gold.

4. An infrared energy emitter according to claim 3 wherein the reflective coating is on an outside surface of the sheath.

5. An infrared energy emitter according to claim 4 wherein the reflective coating comprises gold.

6. An infrared energy emitter according to claim 1 wherein the filament is essentially linear and the reflector has a semicircular cross-sectional shape with the filament at the center thereof whereby the energy reflected from the reflector is directed back onto the filament.

7. An infrared energy emitter according to claim 6 wherein the reflector is removed from the filament by a predetermined distance.

8. An infrared energy emitter according to claim 1 further comprising a space between the sheath and the enclosure and openings at the ends into the space whereby the space can be ventilated to cool the sheath.

9. An infrared energy emitter according to claim 8 wherein the sheath comprises a circular tube open at both ends and wherein the infrared energy emitter further comprises a fluid conductive filter element at each end of the sheath for passing a cooling fluid into and out of the space.

10. An infrared energy emitter according to claim 9 wherein the sheath comprises a quartz material for filtering UV energy from energy emitted by the filament.

11. An infrared energy emitter according to claim 1 wherein the reflective coating extends circumferentially with the sheath through at least 180°.

12. An infrared energy emitter comprising:

a longitudinally extending filament;

a longitudinally extending tubular enclosure of infrared energy transmitting material enclosing the filament, the enclosure being hermetically sealed;

a longitudinally extending outer tubular sheath of infrared energy, transmitting material having two ends and a central longitudinal section therebetween, the tubular enclosure being coaxially disposed within the outer sheath and the central section of the sheath being spaced apart from the enclosure about the entire circumference of the enclosure, thereby forming a space between the sheath and the enclosure, and openings at the ends into the space whereby the space can be ventilated to cool the sheath; and a reflective coating on the sheath extending longitudinally substantially coextensive with the filament, and circumferentially with the sheath at least 180 degrees and comprising a gold metal reflective coating on a surface of the sheath.

13. An infrared energy emitter according to claim 12 further comprising conductive end caps at either end of the sheath, conductive elements connecting ends of the filament to the end caps, the tubular enclosure being suspended within the sheath at the ends of the enclosure, and the openings extend through the end caps into the space for ventilation thereof.

14. A method for heating an object with infrared energy comprising the steps of:

passing a current through an elongated filament to produce infrared energy, the filament being disposed within a hermetically sealed elongated tubular enclosure;

surrounding the enclosure with an outer elongated tubular sheath of infrared energy transmitting material having two ends and a longitudinal central section therebetween, the sheath having a reflective coating that extends longitudinally substantially coextensively with the filament and partially circumferentially with the sheath, and central section of the sheath being spaced apart from the enclosure about the entire circumference of the enclosure to define a space between the sheath and the enclosure;

reflecting infrared radiation from the filament off of the reflective coating on the sheath, back to the filament; and passing infrared radiation toward the object from the filament through a portion of the sheath not occluded by the reflector.

15. A method according to claim 14 comprising the further step of passing a cooling fluid through the space to cool the sheath.

16. An infrared energy emitter according to claim 1 wherein the filament is formed of tungsten and is adapted to emit a spectrum of infrared energy having a peak wavelength between 0.9 and 1.5 microns.

17. An infrared energy emitter according to claim 16 further having a power density of greater than 100 watts per 1meal inch of the filament.

18. An infrared energy emitter according to claim 17 wherein the power density exceeds 500 watts per lineal inch of the filament.

* * * * *

UNITED STATES PATENT AND TRADEMARK OFFICE

CERTIFICATE OF CORRECTION

PATENT NO. : 5,382,805

DATED : January 17, 1995

INVENTOR(S) : MARK G. FANNON et al.

It is certified that error appears in the above-indentified patent and that said Letters Patent is hereby corrected as shown below:

Column 6, claim 4, line 27:
delete "3" and insert --1--

Column 8, claim 14, line 2:
after "and" insert --the--

Column 8, claim 17, line 22:
delete "lmeal" and insert --lineal--

Signed and Sealed this

Twenty-eight Day of March, 1995

Bruce Lehman

*Attest:*

BRUCE LEHMAN

*Attesting Officer*

*Commissioner of Patents and Trademarks*